US007461493B2

(12) United States Patent
Quertelet et al.

(10) Patent No.: US 7,461,493 B2
(45) Date of Patent: Dec. 9, 2008

(54) METHOD FOR MAKING A HOLD-DOWN BRACKET, CORRESPONDING CUT OUT BLANK AND BRACKET

(75) Inventors: Stéphane Quertelet, Remy (FR); James Deciry, Compiegne (FR)

(73) Assignee: I.C.M. Group, Montbard (FR)

( * ) Notice: Subject to any disclaimer, the term of this patent is extended or adjusted under 35 U.S.C. 154(b) by 495 days.

(21) Appl. No.: 10/536,907

(22) PCT Filed: Nov. 17, 2003

(86) PCT No.: PCT/FR03/03401

§ 371 (c)(1),
(2), (4) Date: Feb. 28, 2006

(87) PCT Pub. No.: WO2004/050273

PCT Pub. Date: Jun. 17, 2004

(65) Prior Publication Data

US 2006/0174580 A1 Aug. 10, 2006

(30) Foreign Application Priority Data

Nov. 27, 2002 (FR) ..... 02 14873

(51) Int. Cl.
*E04B 1/38* (2006.01)

(52) U.S. Cl. ..... 52/712; 52/702; 52/285.1

(58) Field of Classification Search ..... 52/702, 52/296, 707, 708, 709, 712, 715, 261, 262, 52/263, 264, 271, 269, 278, 282.1, 282.3, 52/283, 285.1

See application file for complete search history.

(56) References Cited

U.S. PATENT DOCUMENTS

| | | | | |
|---|---|---|---|---|
| 2,321,221 | A * | 6/1943 | Linehan | 403/230 |
| 3,036,347 | A * | 5/1962 | Findleton | 403/217 |
| 4,665,672 | A | 5/1987 | Littleton et al. | |
| 4,897,979 | A * | 2/1990 | Colonias | 52/643 |
| 5,249,404 | A | 10/1993 | Leek et al. | |
| 5,333,435 | A * | 8/1994 | Leek | 52/704 |
| 5,399,044 | A * | 3/1995 | Gilb | 403/231 |
| 6,295,781 | B1 * | 10/2001 | Thompson | 52/712 |

FOREIGN PATENT DOCUMENTS

| | | |
|---|---|---|
| FR | 2 740 805 | 5/1997 |
| FR | 2 773 568 | 7/1999 |

* cited by examiner

*Primary Examiner*—Richard E Chilcot, Jr.
*Assistant Examiner*—Jessica Laux
(74) *Attorney, Agent, or Firm*—Young & Thompson

(57) ABSTRACT

Securement bracket including a base plate and a cylindrical body; the base plate (11) and the cylindrical body are of a single piece, the cylindrical body including two opposite walls called median wings (12, 13) in prolongation at 90° from the base plate (11) and two other opposite walls called flaps (16, 17) in prolongation at 90° from the median wings (12, 13), which have at least one opening in which is disposed a tongue (23) provided at the end of the flaps (16, 17). A process for production of such a bracket and cutout plate for the practice of the process are disclosed.

14 Claims, 2 Drawing Sheets

METHOD FOR MAKING A HOLD-DOWN BRACKET, CORRESPONDING CUT OUT BLANK AND BRACKET

The present invention relates to a securement bracket of the type comprising a base plate with which the bracket is fixed on any support and a tubular body adapted to receive the securement in a profile.

When the bracket is adapted to receive heavy loads, and it is to this type of bracket that the present invention is addressed, it has until now been made in two pieces, a base plate and a body, assembled by welding; this therefore supposes that the bracket, after welding, is subjected to an operation of protection, such as hot galvanization, which is costly.

The present invention has for its object to provide a securement bracket adapted to receive heavy loads made from a single piece from a protected sheet metal, such as pre-galvanized sheet steel.

According to the invention, a process for production of a securement bracket comprising, in a single piece, a base plate and a tubular body, is characterized by the fact that it comprises the steps consisting in:

cutting out a sheet steel blank such that it defines a central portion of generally rectangular shape flanked by two lateral portions which comprise a so-called median wing bordered laterally by a flap itself bordered, on the central portion side, by a slot, each flap being provided, on its free side perpendicular to the slot, with at least one tongue adapted to penetrate a rectangular opening on the other wing;

bending each flap about a bend line perpendicular to the slot so as to make it perpendicular to the adjacent wing;

bending each wing provided with its flap about a bend line parallel to the slot and disposed between the slot and the central portion, so as to render said wings perpendicular to the central portion, the tongue occupying a position at the end of bending in said rectangular opening.

Preferably, the median wing is disposed between the flap and a leg which prolongs the wing and the central portion and is bent at the same time as the wing provided with its flap about the same bend line so as also to be perpendicular to the central portion.

Preferably, each flap is provided with two tongues and each wing with two rectangular openings.

Preferably, each flap is provided with at least one hole, the hole of one flap being in line with the hole of the other flap after the last bend.

The present invention also has for its object a cutout blank for the practice of the above process.

It also has for its object a securement bracket obtained by the above process, which comprises a base plate constituted by the central portion and a cylindrical body constituted by the median wings and flaps.

Preferably, the median wings are parallel to each other and perpendicular to the base plate, the flaps are parallel to each other and perpendicular both to the base plate and to the median wings, which have openings in which are disposed the tongues provided at the ends of the flaps.

The present invention also has for its object a securement bracket comprising a base plate and a cylindrical body characterized by the fact that the base plate and the cylindrical body are of a single piece, the cylindrical body comprising two opposite walls called median wings in prolongation at 90 degrees of the base plate, and two other opposite walls called flaps in prolongation at 90 degrees of the median wings, which have at least one opening in which is disposed a tongue provided at the end of the flaps.

Preferably, each median wing has two openings in which are disposed two tongues provided at the end of each flap.

Preferably, a leg prolongs each of the wings and the base plate.

Preferably, the leg is of triangular shape.

Preferably, the central portion is provided with at least one opening, for example oblong.

Preferably, the facing holes are provided in two opposite walls of the cylindrical body.

So as better to understand the object of the invention, there will now be described, by way of example, purely illustratively and not in a limiting way, an embodiment shown in the accompanying drawings.

Figure 1:
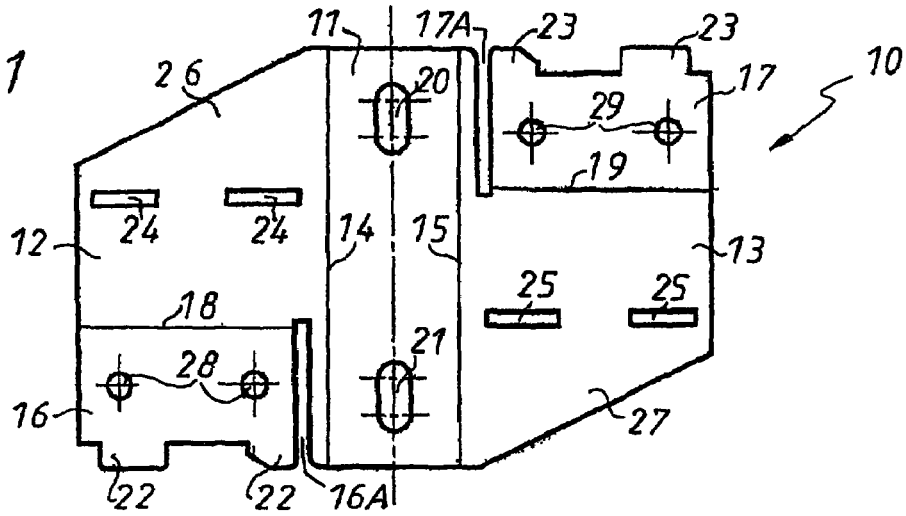
FIG. 1 is a plan view of the precut blank from which is made the securement bracket according to the invention.

The blank 10 according to FIG. 1 comprises a central portion 11 of generally rectangular shape separated into two lateral portions by two parallel bend lines 14, 15; this central portion 11 is adapted to define the base plate of the securement bracket; it is provided with openings, in this case two oblong openings 20 and 21, for the securement of the securement bracket to any support.

None of the lateral portions comprises a median wing 12 disposed between a flap 16 but can be bent back and a leg 26; the flap 16 can be bent back by bending about a bend line 18 perpendicular to the bend lines 14 and 15; it is bordered, on the side of the central portion 11, by a slot 16A parallel to the lines 14 and 15 and opening outwardly; the leg 26 prolongs the wing 12 and the central portion 11 whilst being of triangular shape; it extends from rectangular openings 24 provided in the wing 12 that are disposed one after the other, perpendicular to the bend line 14; the free end of the flap 16, parallel to its bend line 18, carries two tongues 22.

The other lateral portion comprises, in the same way, a median wing 13 disposed between a bendable flap 17 and a leg 27; the flap 17 can be bent back by bending about a bend line 19 perpendicular to the bend lines 14 and 15; it is bordered, on the side of central portion 11, by a slot 17A parallel to the lines 14 and 15 and opening outwardly; the leg 27 prolongs the wing 13 and the central portion 11 whilst being of rectangular shape; it extends from rectangular openings 25 provided in the wing 13 arranged, one after the other, perpendicular to the bend line 14; the free edge of the flap 17, parallel to its bend line 19, carries two tongues 23.

The bend line 18 of the flap 16 is aligned with the rectangular openings 25 of the median wing 13; similarly, the bend line 19 of the flap 17 is aligned with the rectangular openings 24 of the median wing 12; thus, the flap 16 is in line with this leg 27 and a leg 26 in line with the flap 17.

To produce the securement bracket according to the invention, one proceeds as follows.

Figure 2:
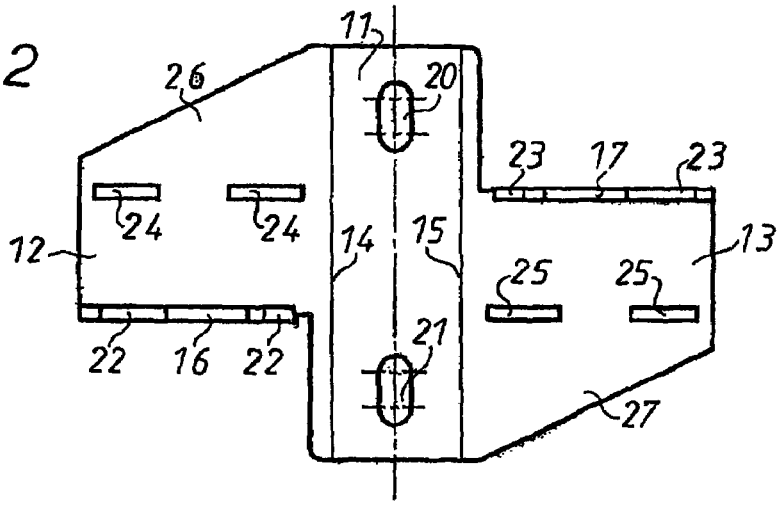
FIG. 2 is a view of the blank of FIG. 1 after a first bending operation.
Figure 3:
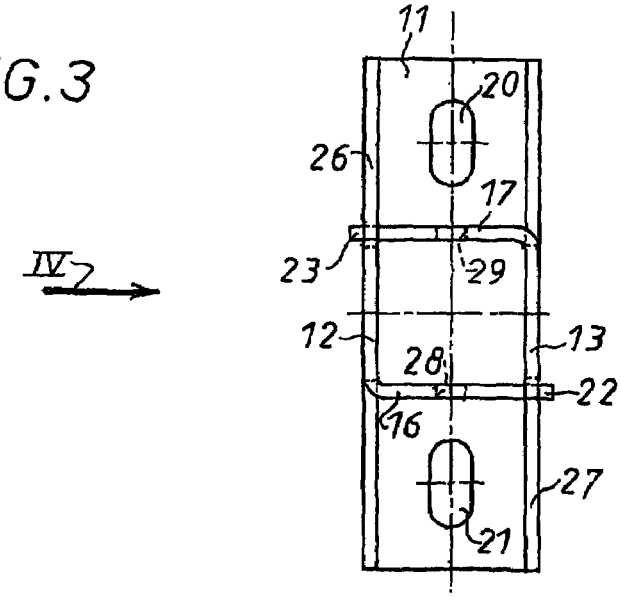
FIG. 3 is a view showing the securement bracket made from FIG. 2 by a second and last bending operation.
Figure 4:
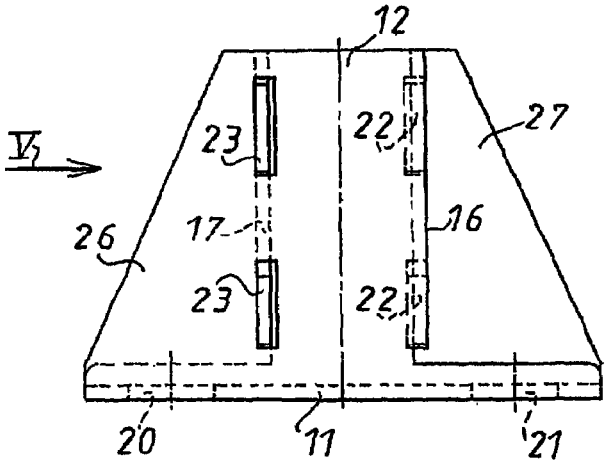
FIG. 4 is a view in the direction of the arrow IV of FIG. 3.
Figure 5:
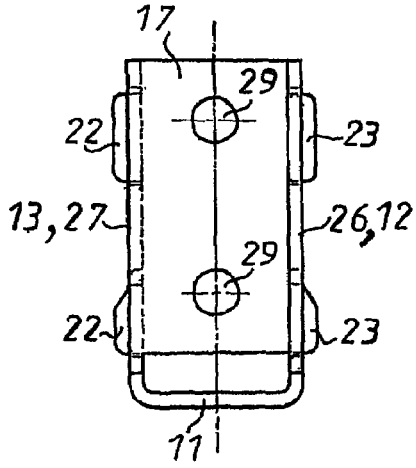
FIG. 5 is a view in the direction of the arrow V of FIG. 4.

A first bend is carried out about the lines 18 and 19 so as to place the flaps 16 and 17 perpendicular to the wings 12 and 13, FIG. 2.

Then, it remains only to bend the wings 12 and 13 about bend lines 14 and 15 until they are disposed perpendicular to the central portion 11; in this operation, the legs 26 and 27 also follow until they are perpendicular to the central portion 11, while remaining in prolongation of the wings.

During this bending, at the end of the latter, the tongues 22 of the flap 16 are disposed in the rectangular openings 25 of the wing 13, and the tongues 23 of the flap 17 are disposed in the rectangular openings 24 of the wing 12, the positions and dimensions of the tongues 23 and 24 being provided correspondingly.

Figure 6:
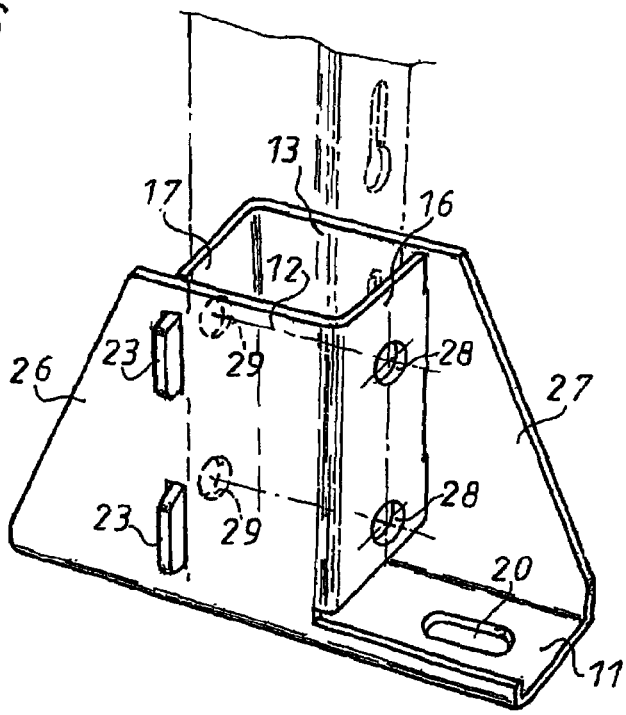
FIG. 6 is a perspective view of the securement bracket according to the invention.

As is seen in FIG. 6, the securement bracket thus comprises a central portion 11 forming a base plate by which it can be easily fixed on any support thanks for example to its oblong openings 20, and a tubular body which in this case has a rectangular cross-section whose faces or walls are constituted by median wings 12, 13 which face each other and by flaps 16, 18 which also face each other; the median wings 12 and 13 are in prolongation of the base plate 11 and the flaps 16 and 17 in prolongation of the median wings 12 and 13, which have openings 24 and 25 in which are disposed the tongues 22 and 23 provided at the end of the flaps 16 and 17; the holes 28 of the flap 16 are in line with the holes 29 of the flap 17, which permits securing any profile whose end is introduced into said body by bolting, this securement reinforcing the rigidity of the tubular body.

Of course, facing holes such as 28 and 29 could be provided in the median wings 12 and 13; moreover, such holes could be provided both in the flaps and in the median wings.

According to a modification (not shown), the ends of the tongues 22 and 23 can be bent and folded back on the wings 13, 12 or against the legs 27, 26 respectively, or else struck so as to provide a lock between the flaps 16, 17 and the wings 13, 12.

It will be understood that the base plate 11 and the body 12-13-16-17 are of a single piece; the legs 26 and 27, also of a single piece, attach the base plate 11 to the said body and play the role of stiffeners.

The securement bracket has been produced in a simple manner from already treated sheet metal, which is favorable from the point of view of cost.

The invention claimed is:

1. Process for the production of a securement bracket comprising, from a single piece, a base plate and a tubular body, characterized by the fact that it comprises the steps consisting in:

cutting out a sheet steel blank such that it defines a central portion (11) of generally rectangular shape bordered by two lateral portions which comprise a so-called median wing (12, 13) bordered laterally by a flap (16, 17) itself bordered, on the central portion side (11), by a slot (16A, 17A); each flap (16, 17) being provided, on its free side perpendicular to the slot (16A, 17A), with at least one tongue (22, 23) adapted to penetrate into a rectangular opening (24, 25) on the other wing (13, 12);

bending each flap (16, 17) about a bend line (18, 19) perpendicular to the slot (16A, 17A) so as to render it perpendicular to the adjacent wing (12, 13);

bending each wing (12, 13) provided with its flap (16, 17) about a bend line (14, 15) parallel to the slot (16A, 17A) and disposed between the slot (16A, 17A) and the central portion (11), so as to render said wings (12, 13) perpendicular to the central portion (11), the tongue (22, 23) being disposed, at the end of bending, in said rectangular opening (24, 25).

2. Process according to claim 1, characterized by the fact that the median wing (12, 13) is disposed between the flap (16, 17) and a leg (26, 27) which prolongs the wing (12, 13) and the central portion (11) and is bent at the same time as the wing (12, 13) provided with its flap (16, 17) about the same bend line (14, 15) so as also to come perpendicular to the central portion (11).

3. Process according to claim 2, characterized by the fact that each flap (16, 17) is provided with two tongues (22, 23) and each wing (12, 13) with two rectangular openings (24, 25).

4. Process according to claim 1, characterized by the fact that each flap (16, 17) is provided with two tongues (22, 23) and each wing (12, 13) with two rectangular openings (24, 25).

5. Process according to claim 1, characterized by the fact that each flap (16, 17) is provided with at least one hole (28, 29), the hole (28) of one flap (16) being in line with the hole (29) of the other flap (17) after the last bending.

6. Cutout blank for the production of a securement bracket, characterized in that it comprises a central portion (11) of generally rectangular shape flanked by two lateral portions which comprise a so-called median wing (12, 13) bordered laterally by a flap (16, 17) itself bordered, on the side of the central portion (11) by a slot (16A, 17A0, each flap (16, 17) being provided, on its free side perpendicular to the slot (16A, 17A) with at least one tongue (22, 23) adapted to penetrate into the rectangular opening (24, 25) of the other wing (13, 12).

7. Securement bracket, characterized in that it comprises a base plate of generally rectangular shape flanked by two lateral portions, in that each of the lateral portions comprises on the one hand a so-called median wing (12, 13) and on the other hand a flap (16, 17), in that each median wing (12, 13) extends perpendicular to the central portion (11) and is connected to this latter by a first bend line, in that each flap (16, 17) is bent about a bend line perpendicular to the first corresponding bend line of the wing (12, 13), in that each flap (16, 17) is provided with at least one tongue (22, 23) which penetrates within a rectangular opening (24, 25) in the other wing (13, 12), and in that the median wings (12, 13) and the flaps (16, 17) constitute a cylindrical body.

8. Securement bracket according to claim 7, characterized by the fact that the median wings (12, 13) are parallel to each other and perpendicular to the base plate, the flaps (16, 17) are parallel to each other and perpendicular both to the base plate and to the median wings (12, 13), which have openings (24, 25) in which are disposed tongues (22, 23) provided at the end of the flaps (16, 17).

9. Securement bracket comprising a base plate and a cylindrical body, characterized by the fact that the base plate (11) and the cylindrical body are of a single piece, the cylindrical body comprising two opposite walls called median wings (12, 13) in prolongation at 90 degrees of the base plate (11) and two other opposite walls called flaps (16, 17) in prolongation at 90 degrees of the median wings (12, 13), which have at least one opening (24, 25) in which is disposed a tongue (22, 23) provided at the end of the flaps (16, 17).

10. Securement bracket according to claim 9, characterized by the fact that each median wing (12, 13) has two openings (24, 25) in which are disposed two tongues (22, 23) provided at the end of each flap (16, 17).

11. Securement bracket according to claim 9, characterized by the fact that a leg (26, 27) prolongs each of the wings (12, 13) and the base plate (11).

12. Securement bracket according to claim 11, characterized by the fact that the leg (26, 27) is of triangular shape.

13. Securement bracket according to claim 9, characterized by the fact that the central portion (11) is provided with at least one opening (20, 21) for example oblong.

14. Securement bracket according to claim 9, characterized by the fact that facing holes (28, 29) are provided in two opposite walls (12, 13-16, 17) of the cylindrical body.

* * * * *